US005166481A

United States Patent [19]

Helft et al.

[11] Patent Number: 5,166,481

[45] Date of Patent: Nov. 24, 1992

[54] TIMING MECHANISM WITH IMPROVED ELECTRICAL CONTACTS

[75] Inventors: Ross G. Helft; Daniel K. Amonett, both of Indianapolis; Lawrence A. May, Greenwood, all of Ind.

[73] Assignee: Emerson Electric Co., St. Louis, Mo.

[21] Appl. No.: 900,799

[22] Filed: Jun. 22, 1992

Related U.S. Application Data

[63] Continuation of Ser. No. 583,202, Sep. 17, 1990, abandoned.

[51] Int. Cl.[5] ..... H01H 43/10

[52] U.S. Cl. ..... 200/38 D; 200/38 R; 200/38 B

[58] Field of Search ..... 200/38 R, 38 B, 38 D, 200/33 B, 6 B, 36 BA, 239, 275, 284, 569

[56] References Cited

U.S. PATENT DOCUMENTS

| | | | |
|---|---|---|---|
| 2,180,921 | 11/1939 | Churchill | 200/284 |
| 3,089,926 | 5/1963 | Everard et al. | 200/38 D |
| 3,268,701 | 8/1966 | Plante et al. | 200/275 |
| 3,737,598 | 6/1973 | Kudoh et al. | 200/38 R |
| 4,081,632 | 3/1978 | Schaffeler | 200/275 |
| 4,191,867 | 3/1980 | Feaster | 200/569 |
| 4,636,603 | 1/1987 | Pliml | 200/284 |

*Primary Examiner*—Harold Broome
*Attorney, Agent, or Firm*—Robert F. Meyer

[57] ABSTRACT

A timing mechanism having electrical switches opening and closing in response to power driven rotating cams. The electrical switches are composed of fixed and movable electrical contact blades which include electrical contacts carried on the blades. For those blades which are switching currents of two amperes or less (120 VAC) a protuberance on one and/or both the fixed and movable blades may form the contact.

4 Claims, 1 Drawing Sheet

TIMING MECHANISM WITH IMPROVED ELECTRICAL CONTACTS

This application is a continuation of application Ser. No. 07/583,202, filed Sep. 17, 1990 now abandoned.

BACKGROUND OF THE INVENTION

The present invention pertains to timing mechanisms and more particularly to timing mechanisms having improved electrical contact blades and electrical contacts.

Timing mechanisms have been used for years to control the functions of appliances such as washers, dryers, and dishwashers. Such timing mechanisms, in general, use power driven rotating cams to open and close electrical switches in accordance with a programmed sequence. Historically, the electrical switches are composed of blades having rivet or welded style contacts carried on the blades. That is, the contacts are formed on the blades from separate materials which are either welded or riveted on the blades. This arrangement is costly and requires high speed forming equipment.

The use of this arrangement is unavoidable whenever the electrical load being handled requires precious metal materials that are different from the blade itself which is typically made of copper. However on low current circuits (2 amperes of less 120 VAC nominal) the same material as the blade may be used as the electrical contact. Therefore, it is a feature of the present invention to provide a timing mechanism useful for making and breaking low current electrical circuits wherein electrical contacts are formed from the same material as an electrical switch blade.

SUMMARY OF THE INVENTION

Accordingly, there is provided a timing mechanism which in general comprises motor driven rotatable cam means, electrical switch means opening and closing in response to the cam means, the electrical switch means including at least one movable electrical contact blade engaging said cam means, and at least one fixed electrical contact blade, at least one of the movable and fixed electrical contact blades having a protuberance providing an electrical contact thereon.

DETAILED DESCRIPTION OF THE INVENTION

Figure 1:
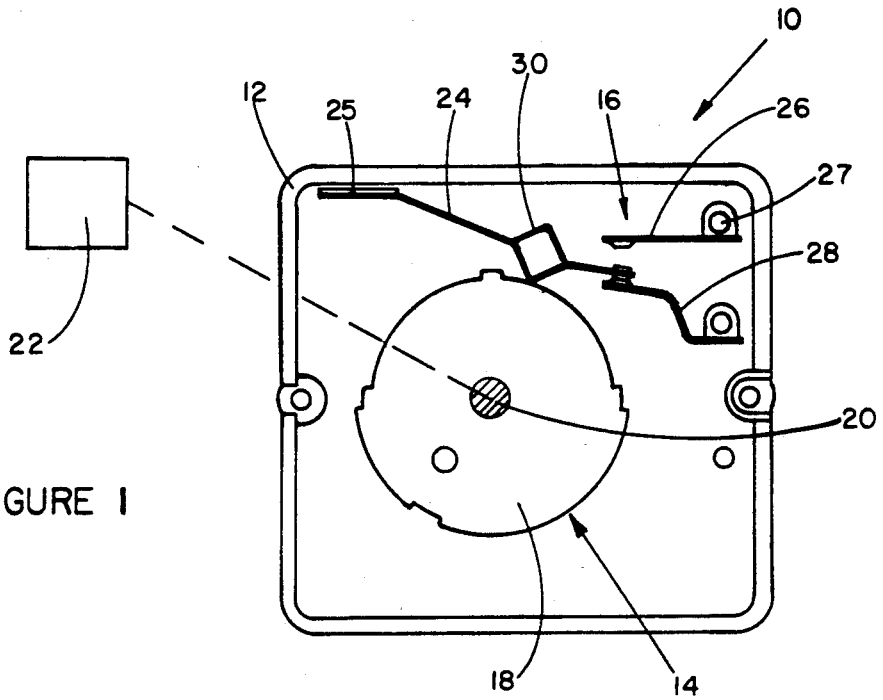
FIG. 1 is a front view of a timing mechanism employing the features of the invention.

Referring now to the drawings there is shown a timing mechanism 10 employing the features of the invention. Timing mechnism 10, in general, includes a housing 12 in which is carried a cam means 14 and electrical switch means 16. Cam means 14 includes at least one cam 18 that is fixedly carried on a shaft 20 which is driven for rotation by a motor in a manner well known in the timing mechanism art.

Switch means 16 includes a movable electrical contact blade 24 that is held in housing 12 through an electrical terminal 25 which extends outside the housing. Fixed electrical contact blades 26 and 28 are held on the housing by suitable means such as rivets 27 which also hold electrical terminals (not shown) extending outside the housing. Movable electrical contact blade 24 includes a follower 30 which rides on the periphery of cam 18 to move the blade between the fixed blades. A suitable material for the blades is a good electrically conductive material such as copper, for example.

It is to be understood that while only a single cam and a single switch means are shown, cam means 14 could include a camstack with a plurality of individual cam surfaces with a corresponding number of switch means individually responsive to them.

Movable electrical contact blade 24 carries a pair of electrical contacts 32 and 34 that are individually welded 36 and 38 or otherwise fixed to the blade. In accordance with the invention, fixed electrical contact blades 26 and 28 have electrical contacts provided from protuberances 40 and 42 formed from the blades. In their preferred form, the protuberances are in the form of dimples. The protuberance may be formed by any suitable forming process such as a metal fabrication pressing operation.

Figure 3:
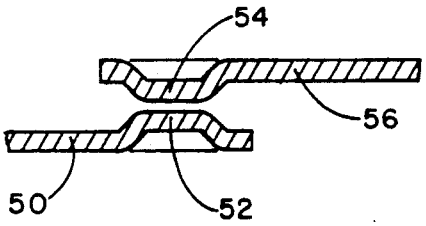
FIG. 3 is another embodiment of the switch means of FIG. 1.
Figure 2:
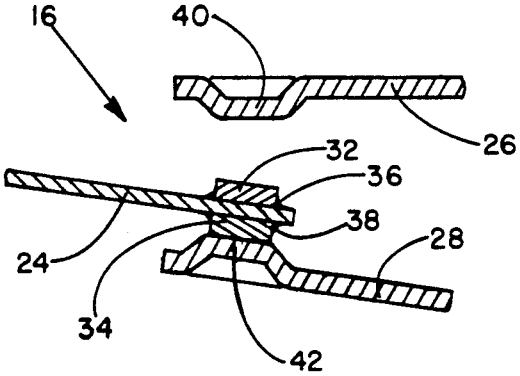
FIG. 2 is a cross section of a portion of the switch means of FIG. 1.

FIG. 3 illustrates another embodiment of the invention. In this embodiment a single throw switch is shown wherein protuberance 52 and 54 can be used on both the movable electrical contact blade 50 and fixed electrical contact blade 56.

Figure 4:
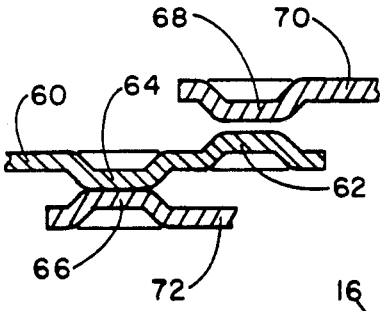
FIG. 4 is yet another embodiment of the switch means of FIG. 1.

FIG. 4 illustrates yet another embodiment of the invention. In this embodiment a double throw switch is shown wherein a movable blade 60 has electrical contacts 62 and 64 that are not in line so as not to overlap. With this arrangement contacts 62 and 64 can, as shown in FIG. 4, be formed as protuberances on opposite surfaces of the blade. Such contacts mate with protuberances 66 and 68 serving an electrical contacts for fixed blades 70 and 72.

What is claimed is:

1. A cam-operated appliance timing mechanism comprising:

(a) a motor driven rotatable cam means and electrical switch means opening an closing electrical circuits operating at least 120 VAC nominal at less than 2 Amperes in response to said cam means, said switch means durable enough to operate at least 5,000 switching cycles, (b) said switch means including:

(1) at least one moveable electrical contact blade engaging said cam means, (2) at least one fixed electrical contact blade cooperating with said moveable electrical contact blade, and (3) at least one of said movable and fixed electrical contact blades having a protuberance extending beyond a surrounding portion of said one movable and fixed electrical contact blade, providing an electrical contact thereon.

2. A timing mechanism according to claim 1 wherein both of said movable and electrical contact blades have a protuberance providing an electrical contact on both of said movable and fixed electrical contact blades.

3. A timing mechanism according to claim 1 wherein there are two spaced fixed electrical contact blades with a movable contact blade operable there between and wherein said two fixed electrical contact blades have a protuberance serving as an electrical contact, said movable contact blade having first and second electrical contacts, one each carried on opposed surfaces thereof, at least one of which is a protuberance formed on its respective surface.

4. A timing mechanism according to claim 3 wherein both said first and second electrical contacts are protuberances formed on their respective blade surfaces.

* * * * *